US012624898B2

(12) United States Patent
Katsumaru et al.

(10) Patent No.: US 12,624,898 B2
(45) Date of Patent: May 12, 2026

(54) HEAT EXCHANGER, AIR-CONDITIONING APPARATUS EQUIPPED WITH HEAT EXCHANGER, AND METHOD OF MANUFACTURING HEAT EXCHANGER

(71) Applicant: Mitsubishi Electric Corporation, Tokyo (JP)

(72) Inventors: Takayuki Katsumaru, Tokyo (JP); Ryohei Kawabata, Tokyo (JP); Tetsuji Saikusa, Tokyo (JP); Keizo Kamada, Tokyo (JP); Yu Tamaki, Tokyo (JP); Mitsuhiro Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 129 days.

(21) Appl. No.: 18/834,407

(22) PCT Filed: Sep. 26, 2022

(86) PCT No.: PCT/JP2022/035579

§ 371 (c)(1),
(2) Date: Jul. 30, 2024

(87) PCT Pub. No.: WO2023/195193

PCT Pub. Date: Oct. 12, 2023

(65) Prior Publication Data

US 2025/0116463 A1 Apr. 10, 2025

(30) Foreign Application Priority Data

Apr. 7, 2022 (WO) ..... PCT/JP2022/017217

(51) Int. Cl.
*F28D 7/16* (2006.01)
*F28F 1/24* (2006.01)

(52) U.S. Cl.
CPC . *F28D 7/16* (2013.01); *F28F 1/24* (2013.01)

(58) Field of Classification Search
CPC ... F28F 1/105; F28F 1/24; F28F 3/025; F28D 7/16; F28D 1/047; F28D 1/05391; F28D 2021/0091

(Continued)

(56) References Cited

U.S. PATENT DOCUMENTS 4,443,921 A * 4/1984 Allemandou ..... F28D 1/0471 228/183
4,876,778 A * 10/1989 Hagihara ..... F28D 1/05383 29/428

(Continued)

FOREIGN PATENT DOCUMENTS

JP 2015-105767 A 6/2015
JP 6165360 B2 7/2017

(Continued)

OTHER PUBLICATIONS

International Search Report of the International Searching Authority mailed Jun. 7, 2022 in corresponding International Patent Application No. PCT/JP2022/017217 (and English translation).

(Continued)

*Primary Examiner* — Jon T. Schermerhorn, Jr.
(74) *Attorney, Agent, or Firm* — Posz Law Group, PLC

(57) ABSTRACT

A heat exchanger includes: flat heat transfer tubes having refrigerant flow passages, extending in an up-down direction, spaced apart from each other in a lateral direction and arranged in two rows; and corrugated fins each provided between associated adjacent ones of the flat heat transfer tubes in the two rows, each joined to the associated adjacent flat heat transfer tubes from top to bottom in the up-down direction, and each having a protruding portion that protrudes forward relative to front-side end portions of the associated adjacent flat heat transfer tubes in a front-side one of the two rows. The position of the front-side end portion of each of the flat heat transfer tubes in the front-side row (Continued)

and the length of the protruding portion in the front-rear direction are not unchanged from top to bottom in the up-down direction.

8 Claims, 13 Drawing Sheets

(58) Field of Classification Search
USPC ..... 165/173
See application file for complete search history.

(56) References Cited

U.S. PATENT DOCUMENTS

| | | | | |
|---|---|---|---|---|
| 8,991,479 | B2 * | 3/2015 | Fujii | F28D 1/0417 165/110 |
| 10,197,313 | B2 * | 2/2019 | Kim | F28F 1/126 |
| 10,584,921 | B2 | 3/2020 | Steinbach et al. | |
| 11,009,300 | B2 * | 5/2021 | Matsumoto | F28D 1/05325 |
| 2007/0169922 | A1 * | 7/2007 | Pautler | F28D 1/05366 165/173 |
| 2011/0139425 | A1 * | 6/2011 | Beamer | F28D 1/0476 165/185 |
| 2018/0100659 | A1 | 4/2018 | Yoshimura et al. | |
| 2018/0328627 | A1 | 11/2018 | Akaiwa et al. | |
| 2020/0103148 | A1 | 4/2020 | Matsumoto et al. | |
| 2021/0108864 | A1 | 4/2021 | Yatsuyanagi et al. | |

FOREIGN PATENT DOCUMENTS

| | | | |
|---|---|---|---|
| JP | 2018-017430 | A | 2/2018 |
| WO | 2017/104050 | A1 | 6/2017 |
| WO | 2018/154806 | A1 | 8/2018 |
| WO | 2020/012577 | A1 | 1/2020 |

OTHER PUBLICATIONS

International Search Report of the International Searching Authority mailed Nov. 8, 2022 in corresponding International Patent Application No. PCT/JP2022/035579 (and English translation).
Extended European Search Report dated Jun. 20, 2025 issued in corresponding European Patent Application No. 22936588.7.

* cited by examiner

HEAT EXCHANGER, AIR-CONDITIONING APPARATUS EQUIPPED WITH HEAT EXCHANGER, AND METHOD OF MANUFACTURING HEAT EXCHANGER

CROSS REFERENCE TO RELATED APPLICATION

This application is a U.S. national stage application of PCT/JP2022/035579 filed on Sep. 26, 2022, which is based on and claims the benefit of priority of the prior International Patent Application No. PCT/JP2022/017217 filed on Apr. 7, 2022, the contents of which are incorporated herein by reference.

TECHNICAL FIELD

The present disclosure relates to a heat exchanger including flat heat transfer tubes and corrugated fins, an air-conditioning apparatus equipped with the heat exchanger, and a method of manufacturing the heat exchanger.

BACKGROUND

In the past, corrugated-fin-and-tube heat exchangers including flat heat transfer tubes and corrugated fins have been widely used.

In an air-conditioning apparatus, the corrugated-fin-and-tube heat exchanger is provided in an outdoor unit. In a heating operation, this heat exchanger operates as an evaporator. When an outdoor air temperature falls to or below freezing point of water, a frosting phenomenon occurs in which moisture contained in the air changes into frost, which forms on the evaporator. When the frost forms on the heat exchanger, the heat transfer area of corrugated fins decreases and airflow passages narrows, thereby reducing the heating performance. In view of this point, a heat exchanger has been proposed in which a front-side end portion of each of corrugated fins protrudes forward relative to a front-side end portion of each of flat heat transfer tubes, that is, a windward-side end portion of the corrugated fin protrudes toward the windward side relative to a windward-side end portion of the flat heat transfer tube, thereby to reduce the likelihood that frost will form (see, for example, Patent Literature 1).

PATENT LITERATURE

Patent Literature 1: Japanese Patent Publication No. 6165360

In a heat exchanger disclosed in Patent Literature 1, a front-side end portion of each of corrugated fins protrudes forward relative to a front-side end portion of each of heat transfer tubes, thereby to improve a frost resistance. However, heat of high-temperature and high-pressure gas refrigerant does not easily transfer to the end portion of the corrugated fin that protrudes forward relative to the end portion of the flat heat transfer tube. Furthermore, once frost forms on the protruding portion of the corrugated fin, it is hard to defrost the protruding portion of the corrugated fins on which the frost forms. In addition, the corrugated fins have a further problem in which its strength is reduced at the protruding portion because the protruding portion protrudes forward relative to the front-side end portion of the flat heat transfer tube.

SUMMARY

The present disclosure is applied to solve the above problems, and relates to a heat exchanger that is improved in defrosting capability without reducing a frost resistance, and is also improved in strength of corrugated fins, and also to an air-conditioning apparatus equipped with the heat exchanger, and a method of manufacturing the heat exchanger.

A heat exchanger according to an embodiment of the present disclosure includes: flat heat transfer tubes each of which has refrigerant flow passages formed therein, extends in an up-down direction that is a tube extending direction, and which are spaced apart from each other in a lateral direction perpendicular to the up-down direction and a front-rear direction that is an flow direction of air, and are arranged in two rows in the front-rear direction; and corrugated fins each of which is provided between associated adjacent ones of the flat heat transfer tubes in the two rows that are adjacent to each other in the lateral direction, each of which is joined to the associated adjacent ones of the flat heat transfer tubes in the two rows, from top to bottom in the up-down direction, and each of which has a protruding portion that protrudes forward relative to front-side end portions of the associated adjacent ones of the flat heat transfer tubes in a front-side one of the two rows. The position of the front-side end portion of each of the flat heat transfer tubes in the front-side row is not unchanged from top to bottom in the up-down direction, and the length of the protruding portion in the front-rear direction is not unchanged from top to bottom in the up-down direction.

An air-conditioning apparatus according to another embodiment of the present disclosure is equipped with the above heat exchanger.

A method of manufacturing a heat exchanger according to still another embodiment of the present disclosure is a method of manufacturing the above heat exchanger, and includes: arranging the flat heat transfer tubes in a rear-side one of the two rows in the lateral direction on a reference plane; setting a spacer on an upper side of the flat heat transfer tubes in the rear-side row to ensure a space between the flat heat transfer tubes in the rear-side row and the flat heat transfer tubes in a front-side one of the two rows; arranging the flat heat transfer tubes in the front-side row in the lateral direction on the spacer; setting each of corrugated fins between associated adjacent ones of the flat heat transfer tubes in the two rows in the lateral direction; causing the corrugated fin to be compressed by the associated adjacent flat heat transfer tubes in the two rows; attaching headers to associated end portions of the flat heat transfer tubes; and joining the headers and the flat heat transfer tubes together by brazing and joining the corrugated fins and the flat heat transfer tubes together by brazing.

In the heat exchanger according to the embodiment of the present disclosure, the corrugated fin has the protruding portion that protrudes forward relative to the front-side end portion of each of the flat heat transfer tubes in the front-side row. The length of the protruding portion in the front-rear direction length is not unchanged from up to bottom in the up-down direction. That is, the corrugated fin has a section where the protruding portion is long and a section where the protruding portion is short with reference to the longitudinal direction of the flat heat transfer tubes. With this configuration, it is possible to improve the defrosting capability without reducing the frost resistance, and also increase the strength of the corrugated fin.

DETAILED DESCRIPTION

Hereinafter, embodiments of the present disclosure will be described with reference to the drawings. It should be noted that the present disclosure is not limited by the following descriptions concerning the embodiments. In addition, relationships in size between components in figures that will be referred to may differ from that of actual ones.

Embodiment 1

Figure 1:
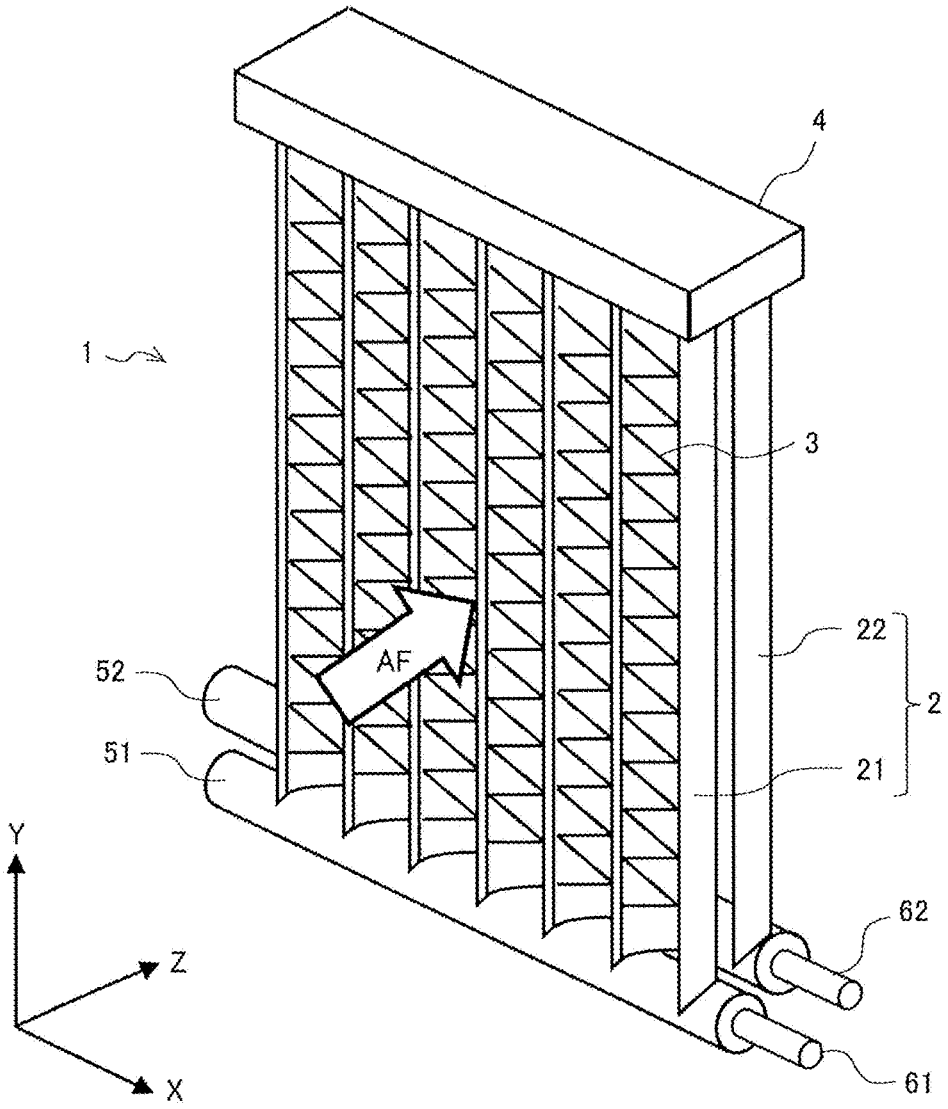
FIG. 1 is a perspective view schematically illustrating a configuration of a heat exchanger according to Embodiment 1.
Figure 2:
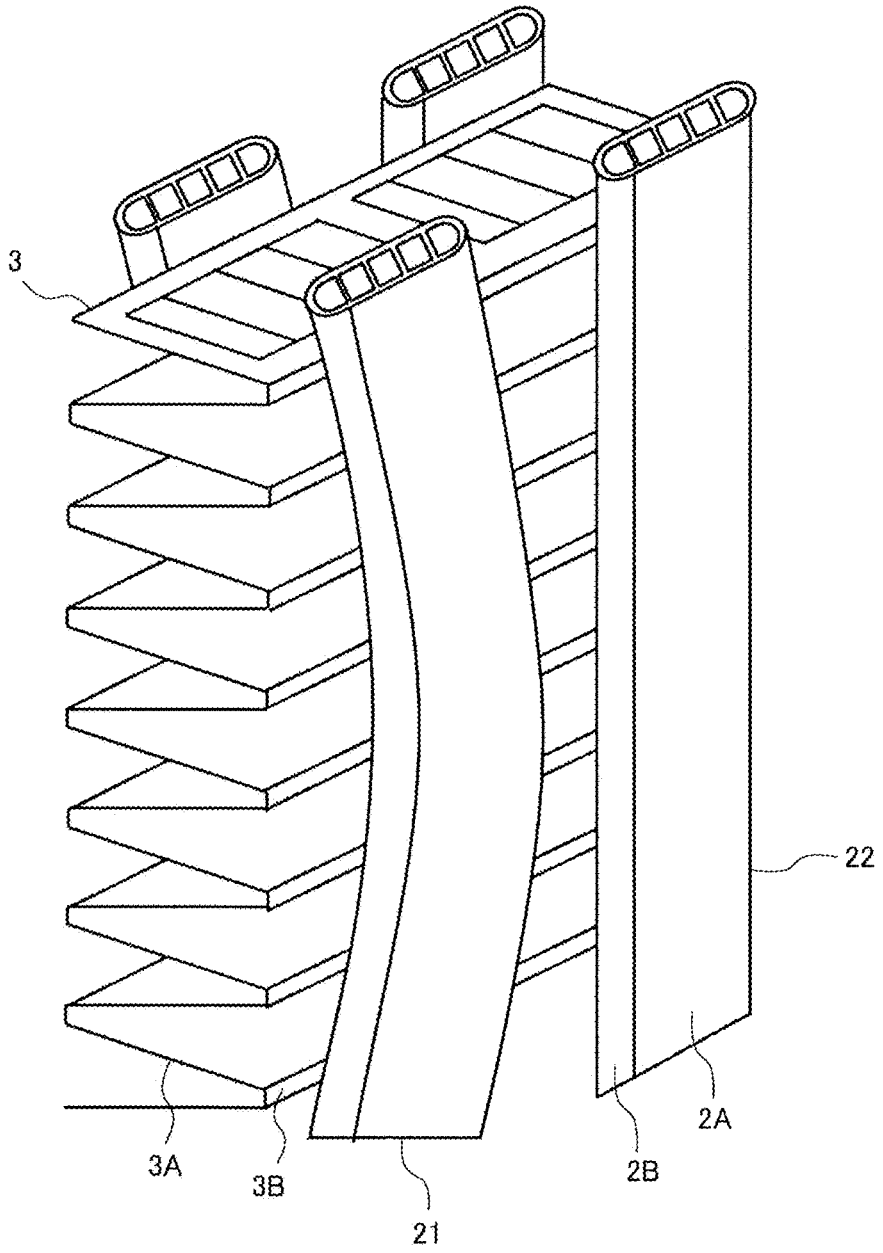
FIG. 2 is a perspective view schematically illustrating a positional relationship between flat heat transfer tubes and corrugated fins of the heat exchanger according to Embodiment 1.

FIG. 1 is a perspective view schematically illustrating a configuration of a heat exchanger 1 according to Embodiment 1. FIG. 2 is a perspective view schematically illustrating a positional relationship between flat heat transfer tubes 2 and corrugated fins 3 of the heat exchanger 1 according to Embodiment 1. It should be noted that an arrow AF in FIG. 1 indicates the flow direction of air that is supplied to the heat exchanger 1, and an arrow X, an arrow Y, and an arrow Z indicate a first direction, a second direction, and a third direction, respectively. The same is true of figures that will be referred to below.

As illustrated in FIG. 1, the heat exchanger 1 according to Embodiment 1 is a corrugated-fin-and-tube heat exchanger. The heat exchanger 1 includes a plurality of flat heat transfer tubes 2, a plurality of corrugated fins 3, a row-connecting header 4, a first header 51, and a second header 52.

As illustrated in FIG. 2, each of the flat heat transfer tubes 2 has an elongated cross section, has a plurality of refrigerant flow passages formed therein, and includes flat-surface portions 2A and curved-surface portions 2B. It is preferable that the flat heat transfer tube 2 be made of metal having high heat conductivity, for example, aluminum. As illustrated in FIG. 1, the plurality of flat heat transfer tubes 2 extend in the second direction (hereinafter, also referred to as "up-down direction") that is also a tube extending direction, and are spaced apart from each other in the first direction (hereinafter, also referred to as "lateral direction") perpendicular to the second direction and the third direction (hereinafter, also referred to as "front-rear direction") that is the also the flow direction of air. The plurality of flat heat transfer tubes 2 need not be spaced apart from each other in a direction that is exactly perpendicular to the second direction and the third direction, and it suffices that the plurality of heat transfer tubes 2 are spaced apart from each other in a direction that is substantially perpendicular to the second direction and the third direction. The flat heat transfer tubes 2 are arranged in two rows in the third direction perpendicular to the first direction and the second direction, that is, in the flow direction of air. In this case, the flat heat transfer tubes 2 need not be arranged in two rows in a direction that is exactly perpendicular to the first direction or the second direction, and it suffices that the flat heat transfer tubes 2 are arranged in two rows in a direction that is substantially perpendicular to the first direction and the second direction. It should be noted that in the following descriptions, the flat heat transfer tubes 2 arranged in a first row that is a front-side row on the windward side are referred to as "front-side flat heat transfer tubes 21," and the flat heat transfer tubes 2 arranged in a second row that is a rear-side row on the leeward side are referred to as "rear-side flat heat transfer tubes 22."

As illustrated in FIG. 2, a plate-like material is folded a number of times such that mountain fold and valley fold are repeated to form a corrugated fin 3, and as a result, the corrugated fin 3 includes flat-surface portions 3A and curved-surface portions 3B. In the corrugated fin 3, the curved-surface portions 3B are joined to a flat-surface portion 2A of the flat heat transfer tube 2 by brazing. Corrugated fins 3 formed in such a manner are each provided between associated adjacent ones of front-side flat heat transfer tubes 21 that are adjacent to each other in the lateral direction and between associated adjacent ones of rear-side flat heat transfer tubes 22 that are adjacent to each other in the lateral direction. The corrugated fins 3 are each joined to the above associated adjacent ones of the front-side flat heat transfer tubes 21 and the associated adjacent ones of the rear-side flat heat transfer tubes 22, from top to bottom in the up-down direction, and transfer heat to those front-side flat heat transfer tubes 21 and rear-side flat heat transfer tubes 22. It is preferable that the corrugated fins 3 be made of metal having high heat conductivity, for example, aluminum.

As illustrated in FIG. 1, the first header 51 is a header in which lower end portions of the front-side flat heat transfer tubes 21 are inserted. A refrigerant pipe 61 is connected to one end of the first header 51. The first header 51 distributes refrigerant that flows thereinto from the refrigerant pipe 61 to the front-side flat heat transfer tubes 21. The first header 51 also merges refrigerant streams that flow out from the front-side flat heat transfer tubes 21 into refrigerant and causes the refrigerant to flow out to the refrigerant pipe 61. The second header 52 is a header in which lower end portions of the rear-side flat heat transfer tubes 22 are inserted. A refrigerant pipe 62 is connected to one end of the second header 52. The second header 52 distributes refrigerant that flows thereinto from the refrigerant pipe 62 to the rear-side flat heat transfer tubes 22. The second header 52 also merges refrigerant streams that flow out from the rear-side flat heat transfer tubes 22 into refrigerant, and then causes the refrigerant to flow out to the refrigerant pipe 62. The row-connecting header 4 is a header in which upper end portions of the front-side flat heat transfer tubes 21 and upper end portions of the rear-side flat heat transfer tubes 22 are inserted. The row-connecting header 4 operates as a bridge that is provided between the front-side flat heat transfer tubes 21 and the rear-side flat heat transfer tubes 22, and through which the refrigerant flows between the front-side flat heat transfer tubes 21 and the rear-side flat heat transfer tubes 22. The row-connecting header 4 merges refrigerant streams that flow from one of the front-side flat heat transfer tubes 21 and the rear-side flat heat transfer tubes 22 into refrigerant, and then distribute the refrigerant in such a manner as to cause the refrigerant to flow to the other flat transfer tubes.

Figure 3:
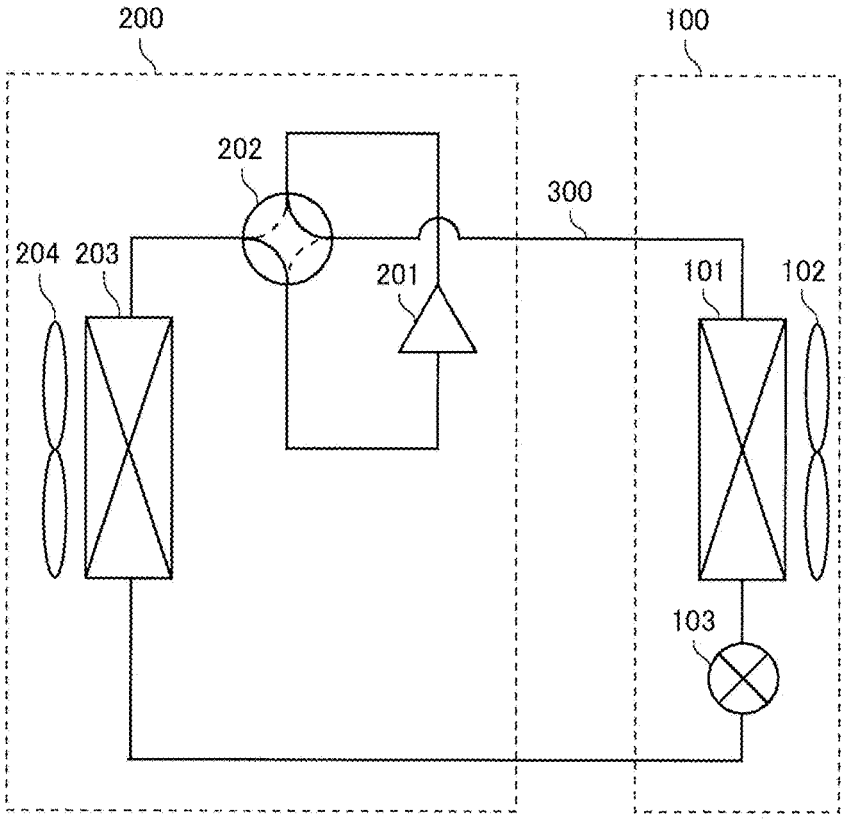
FIG. 3 illustrates the configuration of an air-conditioning apparatus equipped with the heat exchanger according to Embodiment 1.

FIG. 3 illustrates a configuration of an air-conditioning apparatus equipped with the heat exchanger 1 according to Embodiment 1. As illustrated in FIG. 3, the air-conditioning apparatus includes an outdoor unit 200 and an indoor unit 100 that are connected by refrigerant pipes 300, whereby a refrigerant circuit is formed. It should be noted that although it is illustrated that the air-conditioning apparatus according to Embodiment 1 includes one outdoor unit 200 and one indoor unit 100, this is not limiting. The air-conditioning apparatus may include two or more outdoor units 200 and two or more indoor units 100.

The outdoor unit 200 includes a compressor 201, a flow switching device 202, an outdoor heat exchanger 203, and an outdoor fan 204. In this case, the heat exchanger 1 according to Embodiment 1 is used to operate as the outdoor heat exchanger 203. The heat exchanger 1 is provided such that the front-side flat heat transfer tubes 21 are located on the windward side, and the rear-side flat heat transfer tubes 22 are located on the leeward side.

The compressor 201 sucks low-temperature and low-pressure refrigerant, compresses the sucked refrigerant to change it into high-temperature and high-pressure refrigerant, and discharges the high-temperature and high-pressure refrigerant. The compressor 201 is, for example, an inverter compressor whose capacity is controlled by changing the operating frequency. The capacity corresponds to the volume of refrigerant to be delivered per unit time. The flow switching device 202 is, for example, a four-way valve, and changes the refrigerant flow direction to switch the operation between a cooling operation and a heating operation. It should be noted that, in place of the four-way valve, for example, a combination of two-way valves or a combination of three-way valves may be used as the flow switching device 202.

The outdoor heat exchanger 203 operates as an evaporator or a condenser, and causes heat exchange to be performed between air and the refrigerant to evaporate and gasify the refrigerant or condense and liquefy the refrigerant. The outdoor heat exchanger 203 operates as an evaporator in the heating operation, and operates as a condenser in the cooling operation. The outdoor fan 204 is provided close to the outdoor heat exchanger 203 to supply outdoor air to the outdoor heat exchanger 203.

The indoor unit 100 includes an indoor heat exchanger 101, an indoor fan 102, and an expansion device 103. The indoor heat exchanger 101 operates as an evaporator or a condenser, and causes heat exchange to be performed between air and the refrigerant to evaporate and gasify the refrigerant or condense and liquefy the refrigerant. The indoor heat exchanger 101 operates as a condenser in the heating operation, and operates as an evaporator in the cooling operation. The indoor fan 102 is provided close to the indoor heat exchanger 101 to supply indoor air to the indoor heat exchanger 101. The expansion device 103 reduces the pressure of the refrigerant and expands the refrigerant. The expansion device 103 is, for example, an electronic expansion valve whose opening degree can be adjusted. The expansion device 103 is adjusted in opening degree to control the pressure of refrigerant that flows into the indoor heat exchanger 101 in the cooling operation and to control the pressure of refrigerant that flows into the outdoor heat exchanger 203 in the heating operation.

Next, the operating mode of the air-conditioning apparatus according to Embodiment 1 will be described. First of all, the heating operation will be explained. In the heating operation, as indicated by solid lines in FIG. 3, the state of the flow switching device 202 is switched to a state in which the flow switching device 202 causes the discharge side of the compressor 201 and the indoor heat exchanger 101 to be connected to each other. High-temperature and high-pressure gas refrigerant obtained through compression by the compressor 201 and then discharged from the compressor 201 passes through the flow switching device 202 and flows into the indoor heat exchanger 101. The gas refrigerant that has flowed into the indoor heat exchanger 101 exchanges heat with air in an air-conditioning target space that is supplied from the indoor fan 102 to condense and change into liquid refrigerant in the indoor heat exchanger 101. When the liquid refrigerant passes through the expansion device 103, the pressure of the liquid refrigerant is reduced by the expansion device 103 and this liquid refrigerant is changed into two-phase gas-liquid refrigerant. The two-phase gas-liquid refrigerant flows into the outdoor heat exchanger 203, and exchanges heat with outdoor air supplied from the outdoor fan 204 to evaporate to change into gas refrigerant. The gas refrigerant passes through the flow switching device 202 and is re-sucked into the compressor 201.

Next, the cooling operation will be explained. In the cooling operation, as illustrated by dotted lines in FIG. 3, the state of the flow switching device 202 is switched to a state in which the flow switching device 202 causes the discharge side of the compressor 201 and the outdoor heat exchanger 203 to be connected to each other. High-temperature and high-pressure gas refrigerant obtained through compression by the compressor 201 and then discharged from the compressor 201 passes through the flow switching device 202 and flows into the outdoor heat exchanger 203. The gas refrigerant that has flowed into the outdoor heat exchanger 203 exchanges heat with outdoor air supplied from the outdoor fan 204 to condense and change into liquid refrigerant in the outdoor heat exchanger 203. When the liquid refrigerant passes through the expansion device 103, the pressure of the liquid refrigerant is reduced by the expansion device 103 and this liquid refrigerant is changed into two-phase gas-liquid refrigerant. The two-phase gas-liquid refrigerant flows into the indoor heat exchanger 101, and exchanges heat with air in an air-conditioning target space that is supplied from the indoor fan 102 to evaporate and change into gas refrigerant. The gas refrigerant passes through the flow switching device 202 and is re-sucked into the compressor 201.

In the heat exchanger 1, for example, in the case where the first header 51 is a liquid header through which the liquid refrigerant flows, and the second header 52 is a gas header through which the gas refrigerant flows, in the cooling operation, the refrigerant that has flowed into the second header 52 passes through the rear-side flat heat transfer tubes 22, the row-connecting header 4, and the front-side flat heat transfer tubes 21, and then flows out from the first header 51. At the front-side flat heat transfer tubes 21, refrigerant that has been subjected to heat exchange in the rear-side flat heat transfer tubes 22 exchanges heat with air which has not yet subjected to heat exchange. At the rear-side flat heat transfer tubes 22, refrigerant that has not yet been subjected to heat exchange exchanges heat with air that has been subjected to heat exchange at the front-side flat heat transfer tubes 21. Therefore, the heat exchanger 1 according to Embodiment 1 can maintain a temperature difference between refrigerant and air that is a temperature difference with which heat exchange can be effectively performed between them, and thus can improve the heat transfer performance.

In the case where the heat exchanger 1 operates as an evaporator, the surface temperature of the flat heat transfer tubes 2 and the corrugated fins 3 is lower than the temperature of air that passes through the heat exchanger 1. Therefore, moisture contained in the air condenses to cause condensation to occur on the surface of the evaporator and changes into condensed water. When the heating operation is performed under a low outdoor air temperature condition that the outdoor air temperature falls to or below freezing point of water, moisture contained in the air may change into frost, which forms on the evaporator. Thus, the air-conditioning apparatus performs the defrosting operation when the outdoor air temperature reaches a certain temperature. It should be noted that the defrosting operation is an operation that is performed to supply hot gas (high-temperature and high-pressure gas refrigerant) from the compressor 201 to the heat exchanger 1 to prevent frost from forming on the heat exchanger 1 that operates as an evaporator.

Figure 4:
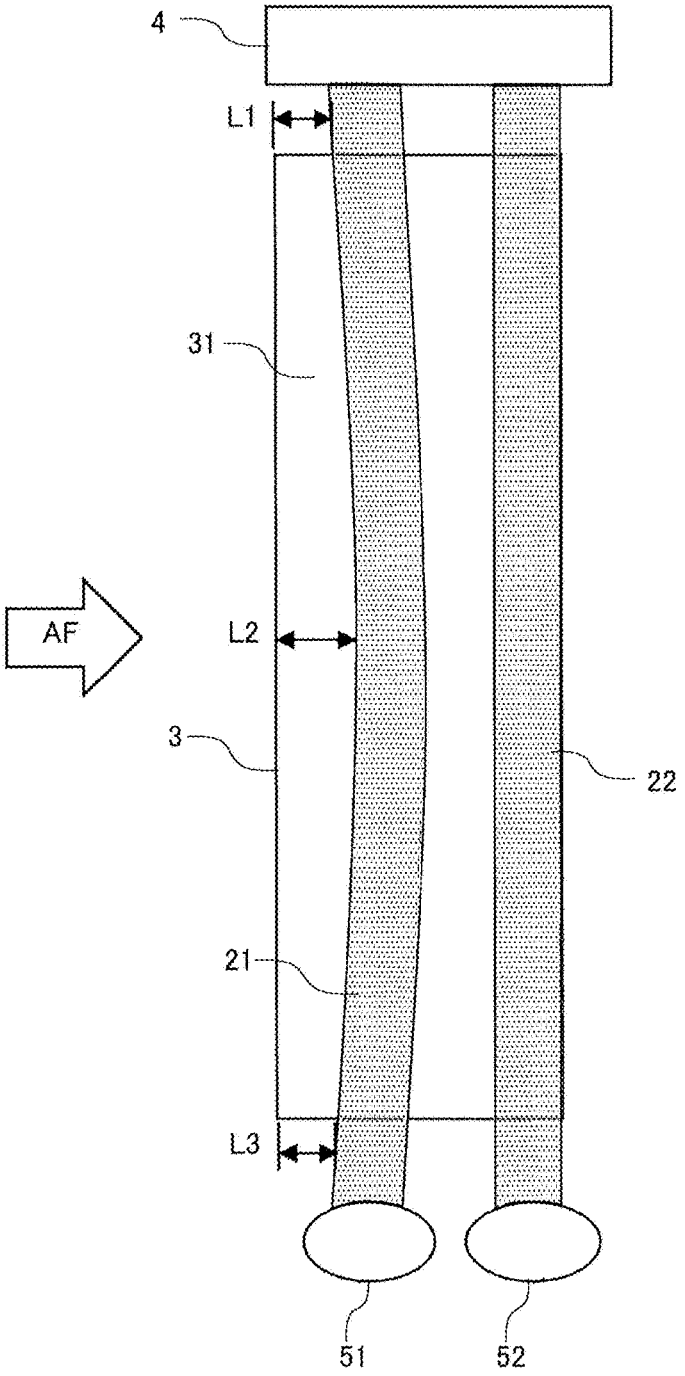
FIG. 4 is a schematic plan view of the heat exchanger according to Embodiment 1.

FIG. 4 is a schematic plan view of the heat exchanger 1 according to Embodiment 1. As illustrated in FIG. 4, the corrugated fin 3 has a protruding portion 31 that protrudes forward relative to the front-side end portion of the front-side flat heat transfer tubes 21, that is, is located more windward than a windward-side end portion of the front-side flat heat transfer tube 21. It should be noted that L1 is the length of the protruding portion 31, in the flow direction of air, at an upper part of the corrugated fin 3; L3 is the length of the protruding portion 31, in the flow direction of air, at a lower part of the corrugated fin 3; and L2 is the length of the protruding portion 31, in the flow direction of air, at a central part of the corrugated fin 3 that is located between the upper part and the lower part.

In the heat exchanger 1 according to Embodiment 1, the length L1 of the protruding portion 31 at the upper part of the corrugated fin 3 and the length L3 of the protruding portion 31 at the lower part of the corrugated fin 3 are both smaller than the length L2 of the protruding portion 31 at the central part of the corrugated fin 3. This is because the length of the corrugated fin 3 is unchanged in the front-rear direction, and the position of the front-side end portion of the corrugated fin 3 is unchanged from top to bottom in the up-down direction, whereas the front-side flat heat transfer tube 21 is curved toward the leeward side (especially, its central part is mostly greatly curved), and the front-side end portion of the front-side flat heat transfer tube 21 is not unchanged from top to bottom in the up-down direction. In such a manner, the relationship of L2>L1 and L2>L3 is satisfied, whereby in the defrosting operation, heat of high-temperature and high-pressure gas refrigerant more easily transfers from an upper part and a lower part of the flat heat transfer tube 2 to the protruding portion 31 of the corrugated fin 3, as compared with an existing heat exchanger. It is therefore possible to improve the defrosting capability of the corrugated fin 3. Furthermore, at a section where the protruding portion 31 is short, it is possible to increase the strength of the corrugated fin 3. In addition, since an adequate protruding amount can be ensured at the protruding portion 31 at the central part of the corrugated fin 3, the frost resistance of the corrugated fin 3 is not reduced. In such a manner, it is possible to improve the defrosting capability of the corrugated fin 3 without reducing the frost resistance.

Figure 5:
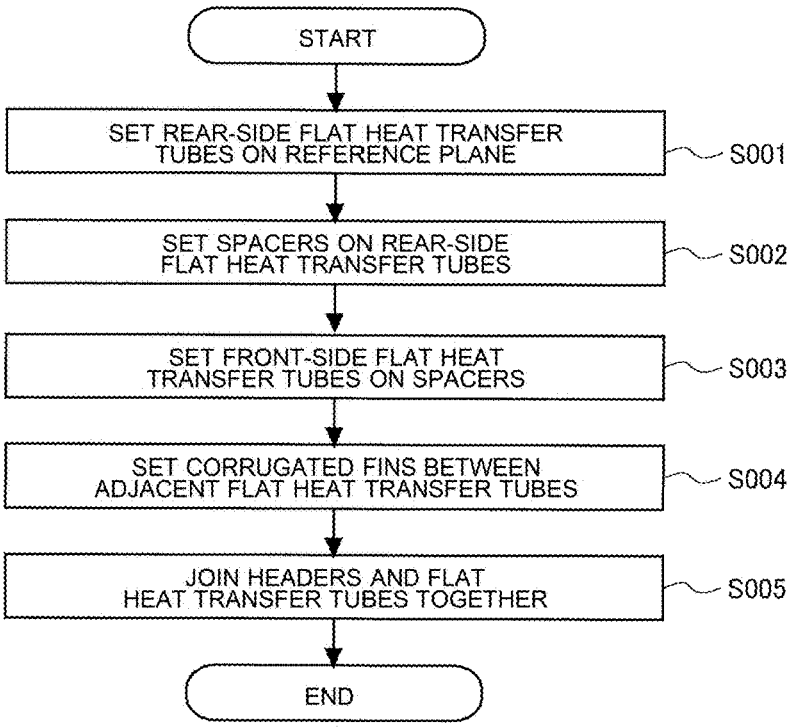
FIG. 5 is a flowchart of manufacturing steps of the heat exchanger according to Embodiment 1.
Figure 6:
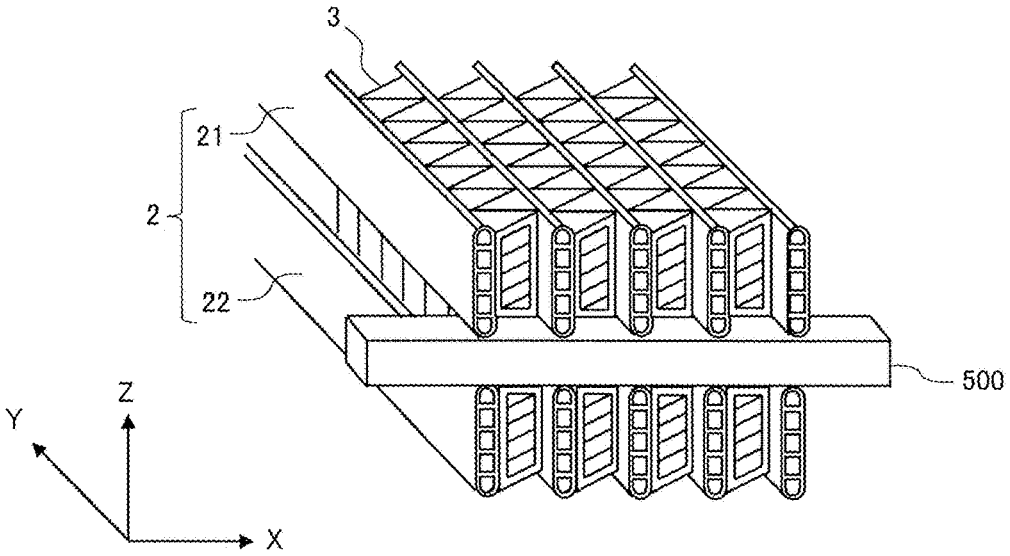
FIG. 6 is a perspective view schematically illustrating the arrangement of the flat heat transfer tubes and the corrugated fins in the manufacturing steps of the heat exchanger according to Embodiment 1.
Figure 7:
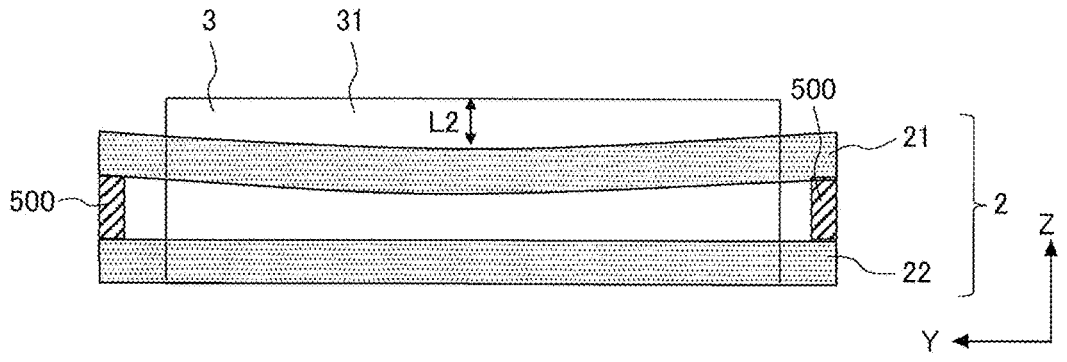
FIG. 7 is a schematic plan view of the flat heat transfer tubes and the corrugated fins as illustrated in FIG. 6 as viewed in a first direction.
Figure 8:
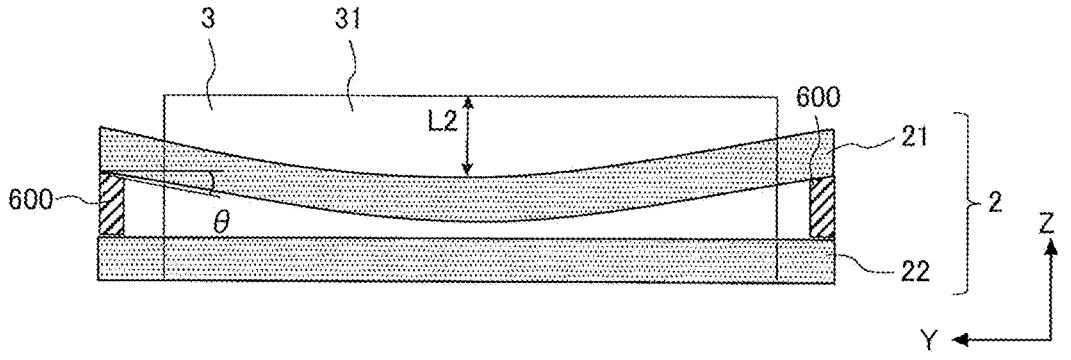
FIG. 8 is a schematic plan view illustrating the case where spacers having surfaces are used in the method of manufacturing the heat exchanger according to Embodiment 1.

FIG. 5 is a flowchart of manufacturing steps of the heat exchanger 1 according to Embodiment 1. FIG. 6 is a perspective view schematically illustrating the arrangement of the flat heat transfer tubes 2 and the corrugated fins 3 in the manufacturing steps of the heat exchanger 1 according to Embodiment 1. FIG. 7 is a schematic plan view of the flat heat transfer tubes 2 and the corrugated fins 3 as illustrated in FIG. 6 as viewed in the first direction. FIG. 8 is a schematic plan view illustrating the case in which spacers 600 having angled surfaces are used in the method of manufacturing the heat exchanger 1 according to Embodiment 1.

The heat exchanger 1 according to Embodiment 1 is formed through the manufacturing steps indicated in FIG. 5. As illustrated in FIG. 6, first, a predetermined number of rear-side flat heat transfer tubes 22 are provided at predetermined intervals in the first direction on a reference plane (S001). It should be noted that the reference plane is parallel to the first direction and the second direction. Next, the spacers 500 are provided on opposite end portions of the rear-side flat heat transfer tubes 22 to ensure respective spaces between the rear-side flat heat transfer tubes 22 and the front-side flat heat transfer tubes 21 (S002). Subsequently, a predetermined number of front-side flat heat transfer tubes 21 are provided on the spacers 500 at predetermined intervals in the first direction (S003). Next, the corrugated fins 3 are set such that between any adjacent two of the front-side flat heat transfer tubes 21 adjacent to each other in the first direction, one corrugated fin 3 is set, and between any adjacent two of the rear-side flat heat transfer tubes 22 adjacent to each other in the first direction, one corrugated fin 3 is set. The adjacent front-side flat heat transfer tubes 21 and the adjacent rear-side heat transfer tubes 22 compress the corrugated fins 3 that are provided between the adjacent front-side flat heat transfer tubes 21 and between the adjacent rear-side heat transfer tubes 22 (S004). In this state, the row-connecting header 4, the first header 51, and the second header 52 are attached to their associated end portions of the front-side flat heat transfer tubes 21 and the rear-side flat heat transfer tubes 22. Finally, in such an assembled state as described above, the headers and the flat heat transfer tubes 2 are joined together by brazing, and the corrugated fins 3 and the flat heat transfer tubes 2 are joined together by brazing, thereby forming the heat exchanger 1 (S005).

At this time, when upper surfaces of the spacers 500 are parallel to the reference plane, the front-side flat heat transfer tubes 21 are curved by their own weights as illustrated in FIG. 7. Therefore, the length L2 of the protruding portion 31 at the central part of the corrugated fin 3 is determined depending on the amount of curvature of the front-side flat heat transfer tubes 21. However, the rear-side flat heat transfer tubes 22 are not curved, since they are located on the reference plane.

It should be noted that in the manufacturing steps of manufacturing the heat exchanger 1, as illustrated in FIG. 8, spacers 600 having upper surfaces inclined at an angle θ relative to the reference plane may be used instead of the spacers 500. In this case, as the angle θ of the upper surfaces of the spacers 600 is increased, the front-side flat heat transfer tubes 21 are more greatly curved. That is, it is possible to increase the length L2 of the protruding portion 31 at the central part of the corrugated fin 3.

The heat exchanger 1 according to Embodiment 1 includes: the plurality of flat heat transfer tubes 2 each of which has refrigerant flow passages formed therein and allowing the refrigerant to flow therethrough, the plurality of flat heat transfer tubes 2 extending in the up-down direction that is an extending direction thereof, the plurality of flat heat transfer tubes 2 being spaced apart from each other in the lateral direction perpendicular to the up-down direction and the front-rear direction that is the flow direction of air, the plurality of flat heat transfer tubes 2 being arranged in two rows in the front-rear direction; and corrugated fins 3 each of which is set between associated adjacent ones of the flat heat transfer tubes 2 in the two rows that are adjacent to each other in the lateral direction, and each of which is joined to the associated adjacent ones of the flat heat transfer tubes 2 in the two rows, from top to bottom in the up-down direction, the corrugated fins 3 having protruding portions 31 that protrude forward relative to front-side end portions of flat heat transfer tubes 2 located in a front-side one of the two rows. In the up-down direction, the position of the front-side end portion of each of the flat heat transfer tubes 2 in the front-side row is not unchanged from top to bottom in the up-down direction, and the length of each of the protruding portions 31 in the front-rear direction is not unchanged from top to bottom in the up-down direction.

In the heat exchanger 1 according to Embodiment 1, the corrugated fins 3 have the protruding portions 31 that protrude forward relative to the front-side end portions of the flat heat transfer tubes 2 located in the front-side row. Furthermore, the length of each of the protruding portions 31 in the front-rear direction length is not unchanged from top to bottom in the up-down direction. That is, each of the corrugated fin 3 has a section where the protruding portion 31 is long and a section where the protruding portion 31 is short with reference to the longitudinal direction of the flat heat transfer tube 2. With this configuration, at the section where the protruding portion 31 is short, in the defrosting operation, heat of high-temperature and high-pressure gas refrigerant easily transfers from the upper part and the lower part of the flat heat transfer tube 2 to the protruding portion 31 of the corrugated fin 3. It is therefore possible to improve the defrosting capability of the corrugated fin 3, and increase the strength of the corrugated fin 3. Since an adequate protruding amount can be ensured at the section where the protruding portion 31 is long, the frost resistance of the corrugated fin 3 is reduced. Accordingly, it is possible to improve the defrosting capability without reducing the frost resistance, and also increase the strength of the corrugated fin 3. Furthermore, the position of the front-side end portion of the flat heat transfer tube 2 in the front-side row is not unchanged from top to bottom in the up-down direction. This is because the flat heat transfer tube 2 in the front-side row is curved in the manufacturing steps of the heat exchanger 1. Because of this configuration in which the flat heat transfer tube 2 is curved, the length of the protruding portion 31 in the front-rear-direction length is not unchanged from top to bottom in the up-down direction. It is therefore possible to more easily manufacture the heat exchanger 1 and reduce the manufacturing costs, as compared with the case where a configuration in which the flat heat transfer tube 2 is curved is not used, that is, the position of the front-side end portion of the flat heat transfer tube 2 in the front-side row is unchanged from top to bottom in the up-down direction and the length of the corrugated fin 3 is changed in the up-down direction such that the length of the protruding portion 31 in the front-rear direction is not unchanged from top to bottom in the up-down direction.

The air-conditioning apparatus according to Embodiment 1 is equipped with the heat exchanger 1 as described above.

The air-conditioning apparatus according to Embodiment 1 can obtain the same advantages as the heat exchanger 1.

The method of manufacturing the heat exchanger 1 according to Embodiment 1 is a method of manufacturing the heat exchanger 1 as described above, and includes: a step of arranging the flat heat transfer tubes 2 in the rear-side row in the lateral direction on the reference plane; a step of setting a spacer 500 on an upper side of the flat heat transfer tubes 2 in the rear-side row to ensure a space between the flat heat transfer tubes 2 in the rear-side row and the flat heat transfer tubes 2 in the front-side row; a step of arranging the plurality of flat heat transfer tubes 2 in the front-side row in the lateral direction on the spacer 500; a step of setting each of the corrugated fins between associated adjacent ones of the flat heat transfer tubes 2 in the two rows in the lateral direction; a step of compressing the corrugated fin 3 by the associated adjacent flat heat transfer tubes 2 in the two rows; a step of attaching each of headers to associated end portions of the flat heat transfer tubes 2; and a step of joining the headers and the flat heat transfer tubes 2 together by brazing and joining the corrugated fins 3 and the flat heat transfer tubes 2 together by brazing.

In the method of manufacturing the heat exchanger 1 according to Embodiment 1, it is possible to obtain the same advantages as in the heat exchanger 1 as described above.

Furthermore, in the method of manufacturing the heat exchanger 1 according to Embodiment 1, the spacers 600 having upper surfaces inclined relative to the reference plane are used.

In the method of manufacturing the heat exchanger 1 according to Embodiment 1, the upper surfaces of the spacers 600 are inclined at a given angle, and as this angle is increased, the front-side flat heat transfer tubes 21 are more greatly curved. That is, it is possible to increase the length L2 of the protruding portion 31 at the central part of the corrugated fin 3.

The heat exchanger 1 according to Embodiment 1 satisfies the relationship of L1<L2 and L3<L2, where L1 is the length of the protruding portion 31 at the upper part of the corrugated fin 3 in the flow direction of air, L2 is the length of the protruding portion 31 at the central part of the corrugated fin 3 in the flow direction of air, and L3 is the length of the protruding portion 31 at the lower part of the corrugated fin 3 in the flow direction of air.

In the heat exchanger 1 according to Embodiment 1, when the relationship of L2>L1 and L2>L3 is satisfied, in the defrosting operation, heat of high-temperature and high-pressure gas refrigerant easily transfers from the upper part and the lower part of the flat heat transfer tubes 2 to the protruding portion 31 of the corrugated fin 3, as compared with the existing heat exchanger. It is therefore possible to improve the defrosting capability of the corrugated fin 3. Furthermore, at the section where the protruding portion 31 is short, it is possible to increase the strength of the corrugated fin 3. Since an adequate protruding amount can be ensured at the section where the protruding portion 31 is long, the frost resistance of the corrugated fin 3 is not reduced. In such a manner as described above, in Embodiment 1, it is possible to improve the defrosting capability of the corrugated fin 3 without reducing the frost resistance thereof.

Embodiment 2

Hereinafter, Embodiment 2 will be described. Regarding Embodiment 2, components that are the same or equivalent to those in Embodiment 1 will be denoted by the same reference signs, and their descriptions will thus be omitted.

The heat exchanger 1 according to Embodiment 2 is different from the heat exchanger 1 according to Embodiment 1 in direction in which the flat heat transfer tubes 2 are curved. To be more specific, the flat heat transfer tubes 2 of Embodiment 1 are curved toward the leeward side, whereas the flat heat transfer tubes 2 of Embodiment 2 are curved toward the windward side in Embodiment 2.

Figure 9:
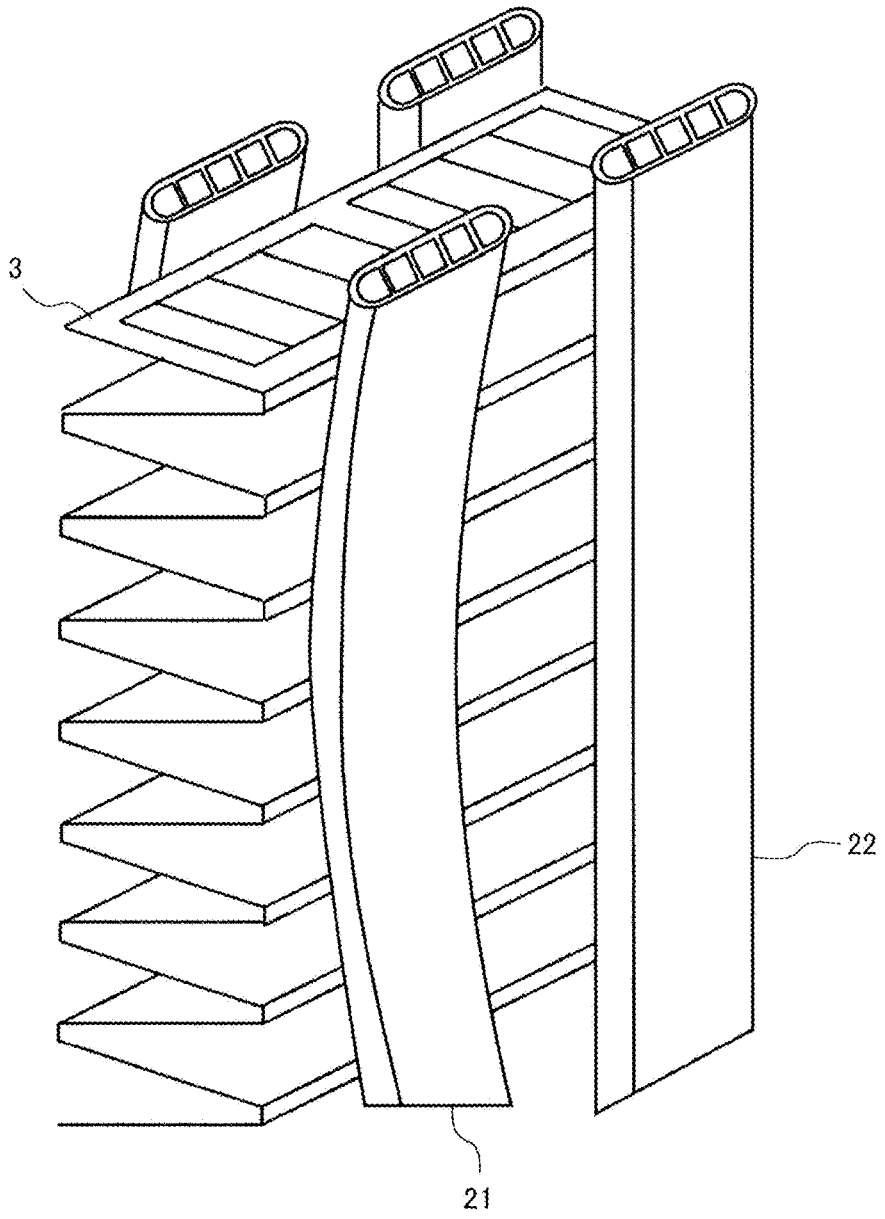
FIG. 9 is a perspective view schematically illustrating a positional relationship between the flat heat transfer tubes and the corrugated fins of a heat exchanger according to Embodiment 2.
Figure 10:
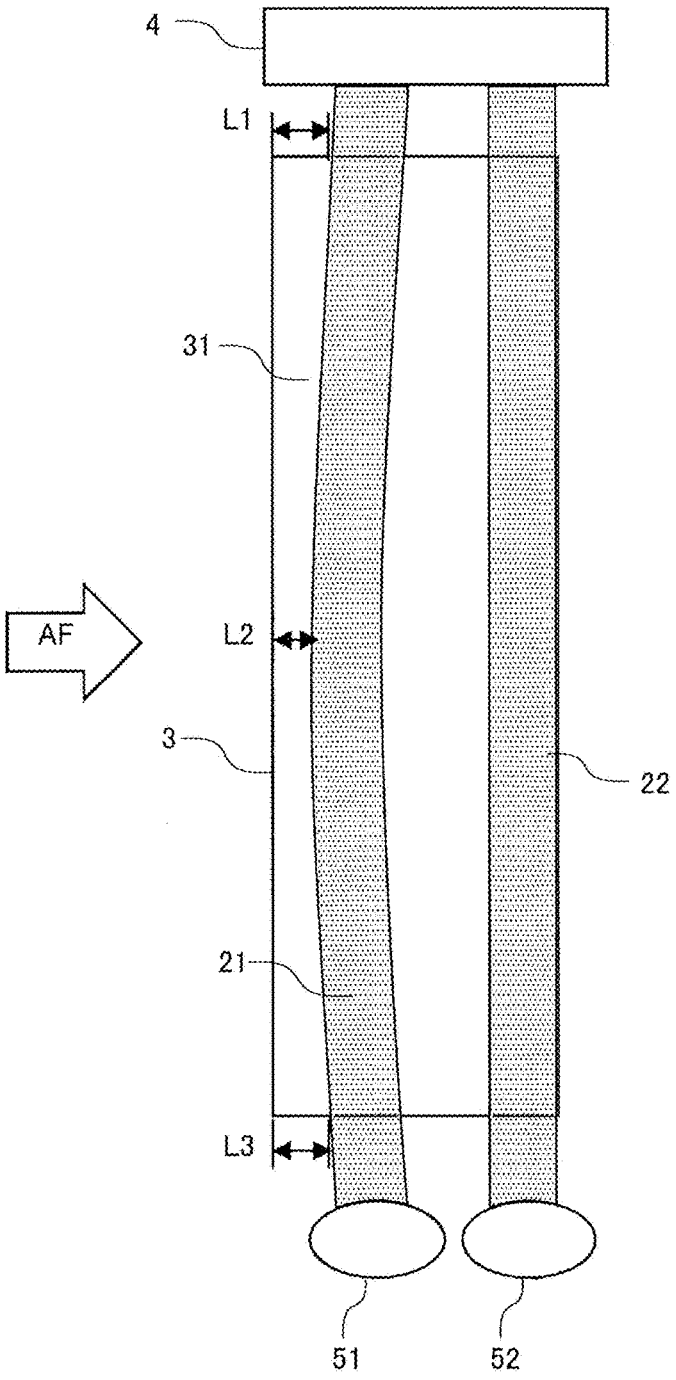
FIG. 10 is a schematic plan view of the heat exchanger according to Embodiment 2.

FIG. 9 is a perspective view schematically illustrating a positional relationship between the flat heat transfer tubes 2 and the corrugated fin 3 of the heat exchanger 1 according to Embodiment 2. FIG. 10 is a schematic plan view of the heat exchanger 1 according to Embodiment 2.

As illustrated in FIGS. 9 and 10, in the heat exchanger 1 according to Embodiment 2, the length L1 of the protruding portion 31 at the upper part of the corrugated fin 3, and the length L3 of the protruding portion 31 at the lower part of the corrugated fin 3 are both greater than the length L2 of the protruding portion 31 at the central part of the corrugated fin 3. In such a manner, since the relationship of L2<L1 and L2<L3 is satisfied, it is possible to reduce the likelihood that the corrugated fin 3 will fall at the time of manufacturing or transporting the heat exchanger 1. Furthermore, at the section where the protruding portion 31 is short, the strength of the corrugated fin 3 can be increased. Furthermore, in the defrosting operation, heat of high-temperature and high-pressure gas refrigerant more easily transfers from the upper part and the lower part of the flat heat transfer tube 2 to the protruding portion 31 of the corrugated fin 3, as compared with the existing heat exchanger. It is therefore possible to improve the defrosting capability of the corrugated fin 3. Since an adequate protruding amount can be ensured at the section where the protruding portion 31 is long, the frost resistance of the corrugated fin 3 is not reduced. In such a manner, in Embodiment 2, it is possible to improve the defrosting capability of the corrugated fin 3 without reducing the frost resistance, and in addition, increase the strength of the corrugated fin 3.

Figure 11:
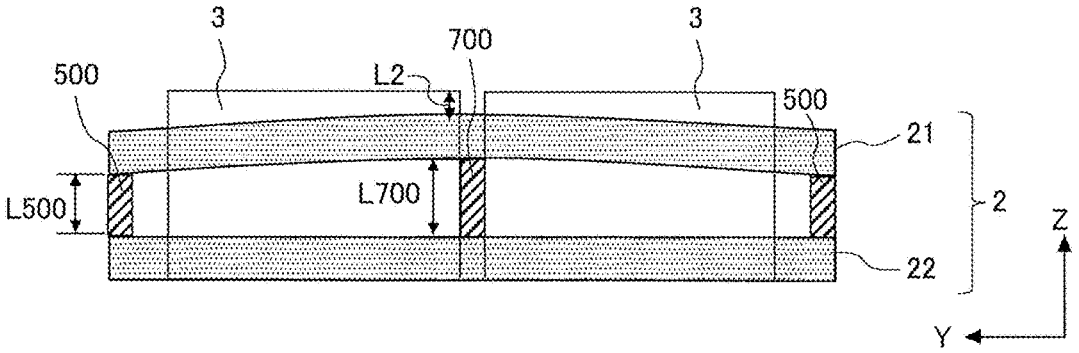
FIG. 11 is a schematic plan view illustrating an example of the method of manufacturing the heat exchanger according to Embodiment 2.
Figure 12:
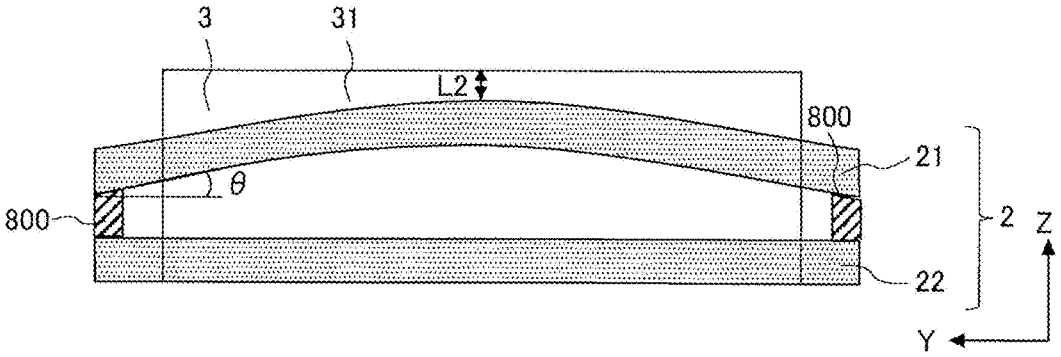
FIG. 12 is a schematic plan view illustrating the case where spacers having angled surfaces are used in the method of manufacturing the heat exchanger according to Embodiment 2.

FIG. 11 is a schematic plan view illustrating an example of the method of manufacturing the heat exchanger 1 according to Embodiment 2. FIG. 12 is a schematic plan view illustrating the case where spacers 800 having angled surfaces are used in the method of manufacturing the heat exchanger 1 according to Embodiment 2.

Next, the method of manufacturing the heat exchanger 1 according to Embodiment 2 will be described with reference to FIGS. 5 and 11. First, a predetermined number of rear-side flat heat transfer tubes 22 are arranged in the first direction at predetermined intervals on a reference plane (S001). The reference plane is parallel to the first direction and the second direction. Next, as illustrated in FIG. 11, the spacers 500 are set on opposite end portions of the rear-side flat heat transfer tubes 22 to ensure a space between the rear-side flat heat transfer tubes 22 and the front-side flat heat transfer tubes 21. Furthermore, a spacer 700 is set on the central part of the rear-side flat heat transfer tube 22 to ensure a space between the rear-side flat heat transfer tubes 22 and the front-side flat heat transfer tubes 21 (S002). In this state, the relationship of L700>L500 is satisfied, where L500 is the length of the spacers 500 in the third direction, and L700 is the length of the spacer 700 in the third direction. It should be noted that as the difference between L700 and L500 increases, the length L2 of the protruding portion 31 at the central part of the corrugated fin 3 decreases. Subsequently, a predetermined number of front-side flat heat transfer tubes 21 are arranged in the first direction at predetermined intervals on the spacers 500 and the spacer 700 (S003). Next, between any adjacent two of the front-side flat heat transfer tubes 21 adjacent to each other in the first direction and between associated adjacent two of the rear-side flat heat transfer tubes 22 adjacent to each other in the first direction, respective corrugated fins 3, that is, two corrugated fins 3, are set such that the spacer 700 is interposed between the two corrugated fins 3, and a front-side one of the two corrugated fins 3 is compressed by the above adjacent two front-side flat heat transfer tubes 21 and the other of the two corrugated fins 3, that is, a rear-side corrugated fin 3 thereof, is compressed by the above adjacent two rear-side flat heat transfer tubes 22 (S004). In this state, the row-connecting header 4, the first header 51, and the second header 52 are attached to associated end portions of the front-side flat heat transfer tubes 21 and the rear-side flat heat transfer tubes 22. Finally, in such assembled state as described above, the headers and the flat heat transfer tubes 2 are joined by brazing, and the corrugated fins 3 and the flat heat transfer tubes 2 are joined together by brazing, thereby forming the heat exchanger 1 (S005).

It should be noted that as illustrated in FIG. 12, spacers 800 having upper surfaces inclined at an angle θ relative to the reference plane may be used instead of the spacers 500 and 700. In this case, as the angle θ of the upper surfaces of the spacers 800 is increased, the front-side flat heat transfer tube 21 are more greatly curved. That is, it is possible to decrease the length L2 of the protruding portion 31 at the central part of the corrugated fin 3. In this case, in the manufacturing method, since the spacer 700 is not provided on the upper side of the central part of the rear-side flat heat transfer tubes 22, it is possible to reduce, to 1, the number of corrugated fins 3 to be provided in a space located between any adjacent two of the front-side flat heat transfer tubes 21 in the first direction and between associated adjacent two of the rear-side flat heat transfer tubes 22 in the first direction.

The heat exchanger 1 according to Embodiment 2 as described above satisfies the relationship of L1>L2 and L3>L2, where L1 is the length of the protruding portion 31 at the upper part of the corrugated fin 3 in the flow direction of air, L2 is the length of the protruding portion 31 at the central part of the corrugated fin 3 in the flow direction of air, and L3 is the length of the protruding portion 31 at the lower part of the corrugated fin 3 in the flow direction of air.

In the heat exchanger 1 according to Embodiment 2, the relationship of L2<L1 and L2<L3 is satisfied, whereby it is possible to reduce the likelihood that the corrugated fin 3 will fall at the time of manufacturing or transporting the heat exchanger 1. Furthermore, at the section where the protruding portion 31 is short, it is possible to increase the strength of the corrugated fin 3. In addition, in the defrosting operation, heat of high-temperature and high-pressure gas refrigerant more easily transfers from the upper part and lower part of the flat heat transfer tube 2 to the protruding portion 31 of the corrugated fin 3, as compared with the existing heat exchanger. The defrosting capability of the corrugated fin 3 can thus be improved. Since an adequate protruding amount can be ensured at the section where the protruding portion 31 is long, the frost resistance of the corrugated fin 3 is not reduced. In such a manner as described above, in Embodiment 2, it is possible to improve the defrosting capability of the corrugated fin 3 without reducing the frost resistance, and in addition, increase the strength of the corrugated fin 3.

Embodiment 3

Hereinafter, Embodiment 3 will be described. Regarding Embodiment 3, components that are the same or equivalent to those in Embodiment 1 or 2 will be denoted by the same reference signs, and their descriptions will thus be omitted.

Figure 13:
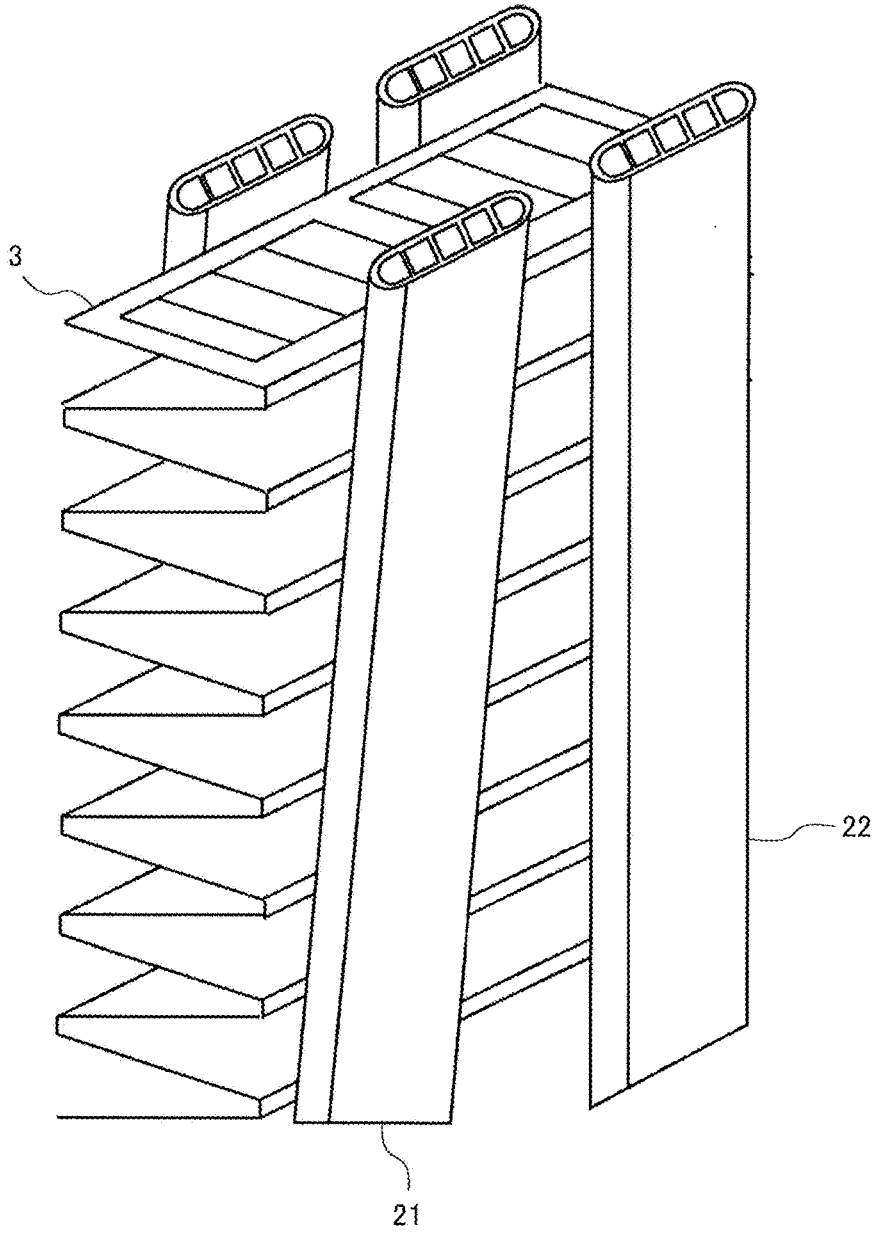
FIG. 13 is a perspective view schematically illustrating a positional relationship between the flat heat transfer tubes and the corrugated fins of a heat exchanger according to Embodiment 3.
Figure 14:
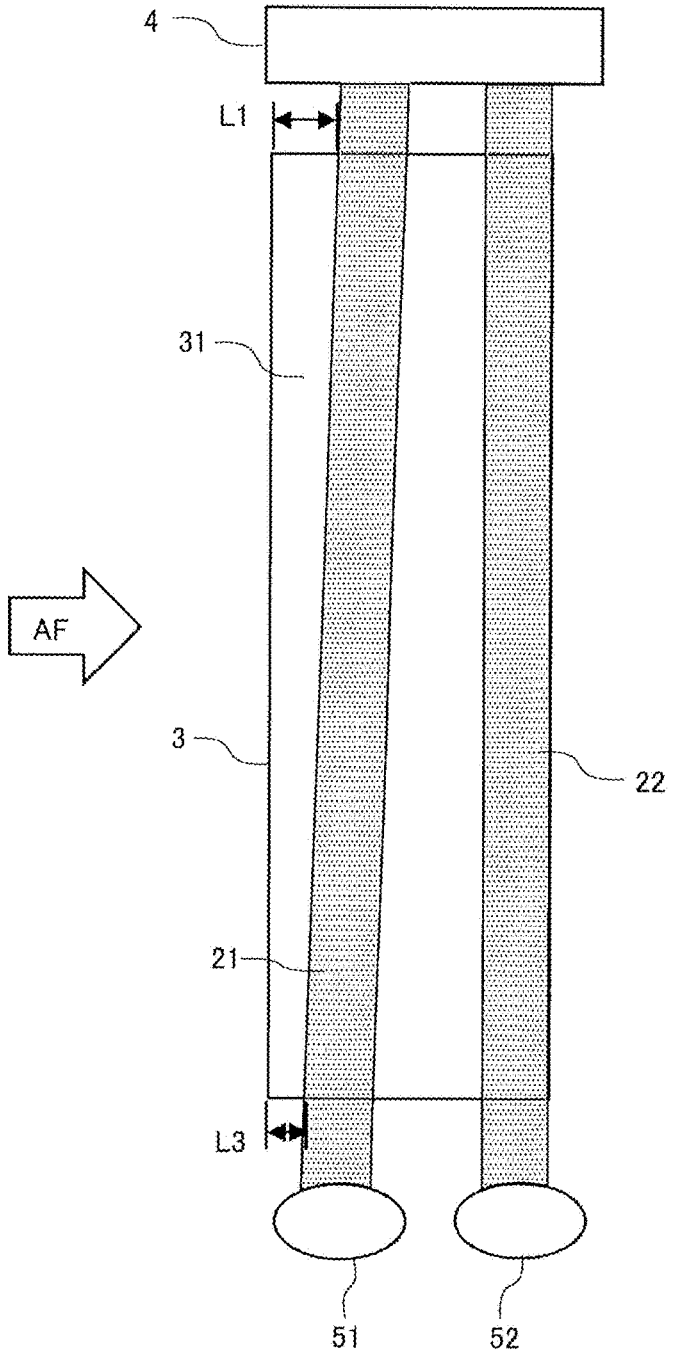
FIG. 14 is a schematic plan view of the heat exchanger according to Embodiment 3.

FIG. 13 is a perspective view schematically illustrating a positional relationship between the flat heat transfer tubes 2 and the corrugated fin 3 of the heat exchanger 1 according to Embodiment 3. FIG. 14 is a schematic plan view of the heat exchanger 1 according to Embodiment 3. As illustrated in FIGS. 13 and 14, in the heat exchanger 1 according to Embodiment 3, the length L1 of the protruding portion 31 at the upper part of the corrugated fin 3 is greater than the length L3 of the protruding portion 31 at the lower part of the corrugated fin 3, and the length of the protruding portion 31 gradually decreases from the upper part to the lower part of the corrugated fin 3.

In the defrosting operation, hot gas finally reaches the lower part of the heat exchanger 1, and frost on the lower part of the heat exchanger 1 may remain unmelted. The length L3 of the protruding portion 31 at the lower part of the corrugated fin 3 is decreased smaller than the length L1 of the protruding portion 31 at the upper part of the corrugated fin 3. As a result, heat of high-temperature and high-pressure gas refrigerant easily transfers from the lower part of the flat heat transfer tubes 2 to the protruding portion 31 of the corrugated fin 3. It is therefore possible to improve the defrosting capability of the corrugated fin 3, and reduce the likelihood that frost will remain unmelted. Furthermore, since an adequate protruding amount can be ensured at the upper part of the corrugated fin 3 where the protruding portion 31 is long, the frost resistance of the corrugated fin 3 is not reduced. In such a manner, in Embodiment 3, it is possible to improve the defrosting capability of the corrugated fin 3 without reducing the frost resistance.

In the heat exchanger 1 according to Embodiment 3 as described above, the relationship of L1>L3 is satisfied, where L1 is the length of the protruding portion 31 at the upper part of the corrugated fin 3 in the flow direction of air, and L3 is the length of the protruding portion 31 at the lower part of the corrugated fin 3 in the flow direction of air, and the length of the protruding portion 31 gradually decreases from the upper part to the lower part of the corrugated fin 3.

In the heat exchanger 1 according to Embodiment 3, heat of high-temperature and high-pressure gas refrigerant easily transfers from the lower part of the flat heat transfer tube 2 to the protruding portion 31 of the corrugated fin 3. It is therefore possible to improve the defrosting capability of the corrugated fin 3, and reduce the likelihood that frost will remain unmelted. Since an adequate protruding amount can be ensured at the section where the protruding portion 31 is long, the frost resistance of the corrugated fin 3 is not reduced. In such a manner, in Embodiment 3, it is possible to improve the defrosting capability of the corrugated fin 3 without reducing the frost resistance.

Embodiment 4

Hereinafter, Embodiment 4 will be described. Regarding Embodiment 4, components that are the same or equivalent to those in any of Embodiments 1 to 3 will be denoted by the same reference signs, and their descriptions will thus be omitted.

Figure 15:
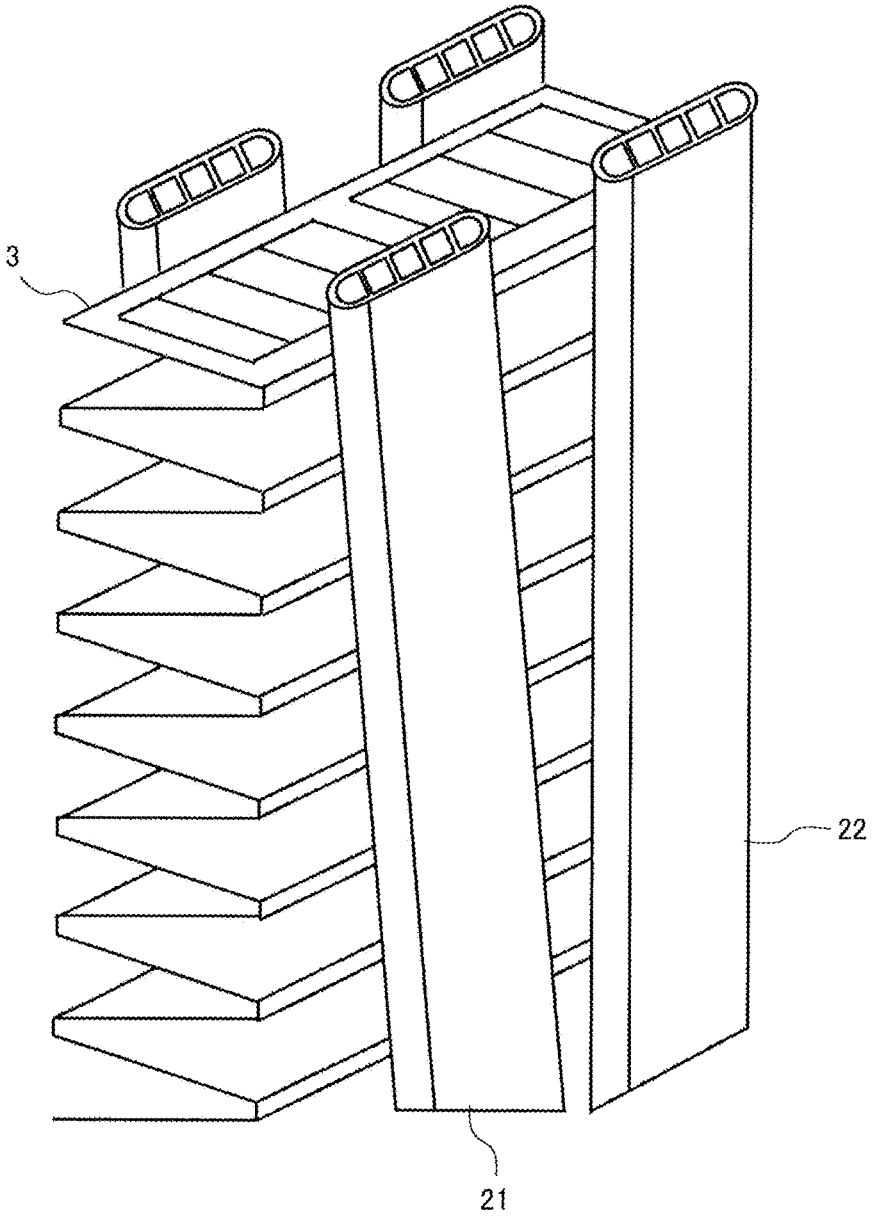
FIG. 15 is a perspective view schematically illustrating the arrangement relationship between the flat heat transfer tubes and the corrugated fin of a heat exchanger according to Embodiment 4.
Figure 16:
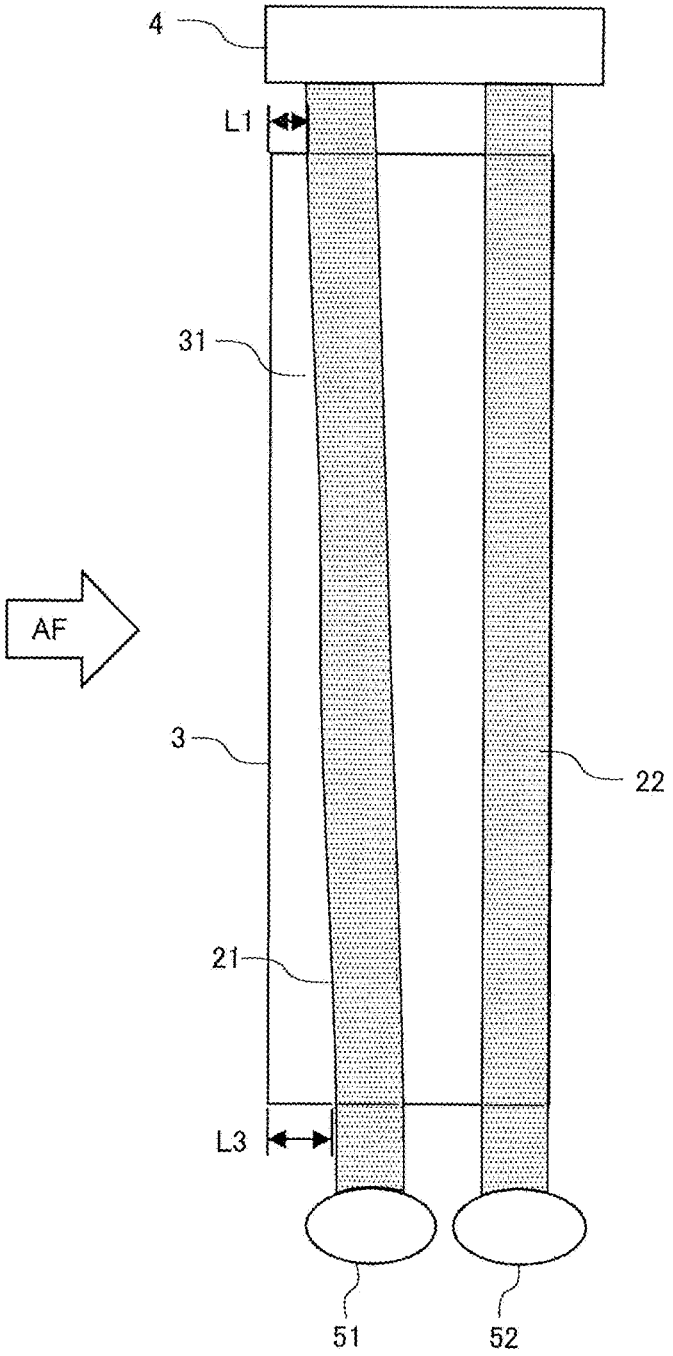
FIG. 16 is a schematic plan view of the heat exchanger according to Embodiment 4.

FIG. 15 is a perspective view schematically illustrating a positional relationship between the flat heat transfer tubes 2 and the corrugated fin 3 of the heat exchanger 1 according to Embodiment 4. FIG. 16 is a schematic plan view of the heat exchanger 1 according to Embodiment 4. As illustrated in FIGS. 15 and 16, in the heat exchanger 1 according to Embodiment 4, the length L1 of the protruding portion 31 at the upper part of the corrugated fin 3 is smaller than the length L3 of the protruding portion 31 at the lower part of the corrugated fin 3, and the length of the protruding portion 31 gradually increases from the upper part to the lower part of the corrugated fin 3.

At the upper part of the heat exchanger 1, an aerodynamic force is great, and a heat exchange performance is high. It is therefore possible to reduce a ventilation resistance in the heat exchanger 1 in the case where the length L1 of the protruding portion 31 at the upper part of each of the corrugated fins 3 provided in the upper part of the heat exchanger 1 is smaller than the length L3 of the protruding portion 31 at the lower part of each of the corrugated fins 3. As a result, energy required to rotate the outdoor fan 204 is reduced, and it is therefore possible to improve the performance of the air-conditioning apparatus. Furthermore, since an adequate protruding amount can be ensured at part of the lower part of the corrugated fin 3 where the protruding portion 31 is long, the frost resistance of the corrugated fin 3 is not reduced. In such a manner as described above, in Embodiment 4, it is possible to improve the performance of the air-conditioning apparatus without reducing the frost resistance of the corrugated fin 3.

In the heat exchanger 1 according to Embodiment 4 as described above, the relationship of L1<L3 is satisfied, where L1 is the length of the protruding portion 31 at the upper part of the corrugated fin 3 in the flow direction of air, and L3 is the length of the protruding portion 31 at the lower part of the corrugated fin 3 in the flow direction of air, and the length of the protruding portion 31 gradually increases from the upper part to the lower part of the corrugated fin 3.

In the heat exchanger 1 according to Embodiment 4, the ventilation resistance in the heat exchanger 1 can be reduced, the energy required to rotate the outdoor fan 204 is reduced, and the performance of the air-conditioning apparatus can be improved. Since an adequate protruding amount can be ensured at the section where the protruding portion 31 is long, the frost resistance of the corrugated fin 3 is not reduced. In such a manner, in Embodiment 4, it is possible to improve the performance of the air-conditioning apparatus without reducing the frost resistance of the corrugated fin 3.

The invention claimed is:

1. A heat exchanger comprising:

a plurality of flat heat transfer tubes each having refrigerant flow passages formed therein and allowing refrigerant to flow therethrough, the plurality of flat heat transfer tubes extending in an up-down direction that is a tube extending direction, the plurality of flat heat transfer tubes being spaced apart from each other in a lateral direction perpendicular to the up-down direction and a front-rear direction that is an flow direction of air, and being also arranged in two rows in the front-rear direction; and corrugated fins each of which is provided between associated adjacent ones of the flat heat transfer tubes in the two rows that are adjacent to each other in the lateral direction, each of which is joined to the associated adjacent ones of the flat heat transfer tubes in the two rows, from top to bottom in the up-down direction, and each of which has a protruding portion that protrudes forward relative to front-side end portions of the associated adjacent ones of the flat heat transfer tubes in the front-side row, wherein a position of a front-side end portion of each of the corrugated fins is unchanged from top to bottom in the up-down direction, a position of the front-side end portion of each of the flat heat transfer tubes in the front-side row is not unchanged from top to bottom in the up-down direction, and a length of the protruding portion in the front-rear direction is not unchanged from top to bottom in the up-down direction.

2. The heat exchanger of claim 1, wherein a relationship of L1<L2 and L3<L2 is satisfied, where L1 is a length of the protruding portion at an upper part of the corrugated fin in the front-rear direction, L2 is a length of the protruding portion at a central part of the corrugated fin in the front-rear direction, and L3 is a length of the protruding portion at a lower part of the corrugated fin in the front-rear direction.

3. The heat exchanger of claim 1, wherein a relationship of L1>L2 and L3>L2 is satisfied, where L1 is a length of the protruding portion at an upper part of the corrugated fin in the front-rear direction, L2 is a length of the protruding portion at a central part of the corrugated fin in the front-rear direction, and L3 is a length of the protruding portion at a lower part of the corrugated fin in the front-rear direction.

4. The heat exchanger of claim 1, wherein a relationship of L1>L3 is satisfied, where L1 is a length of the protruding portion at an upper part of the corrugated fin in the front-rear direction, and a length of the protruding portion at a lower part of the corrugated fin in the front-rear direction, and a length of the protruding portion gradually decreases from the upper part to the lower part of the corrugated fin.

5. The heat exchanger of claim 1, wherein a relationship of L1<L3 is satisfied, where L1 is a length of the protruding portion at an upper part of the corrugated fin in the front-rear direction, and L3 is a length of the protruding portion at a lower part of the corrugated fin in the front-rear direction, and a length of the protruding portion gradually increases from the upper part to the lower part of the corrugated fin.

6. An air-conditioning apparatus equipped with the heat exchanger of claim 1.

7. A method of manufacturing the heat exchanger of claim 1, the method comprising:

arranging the flat heat transfer tubes in a rear-side one of the two rows in the lateral direction on a reference plane;

setting a spacer on an upper side of the flat heat transfer tubes in the rear-side row to ensure a space between the flat heat transfer tubes in the rear-side row and the flat heat transfer tubes in a front-side one of the two rows;

arranging the flat heat transfer tubes in the front-side row in the lateral direction on the spacer;

setting each of corrugated fins between associated adjacent ones of the flat heat transfer tubes in the two rows in the lateral direction;

causing the corrugated fin to be compressed by the associated adjacent flat heat transfer tubes in the two rows;

attaching headers to associated end portions of the flat heat transfer tubes; and joining the headers and the flat heat transfer tubes together by brazing and joining the corrugated fins and the flat heat transfer tubes together by brazing.

8. The method of manufacturing the heat exchanger of claim 7, wherein the spacer has an upper surface inclined relative to the reference plane.

* * * * *